US007333126B2

(12) United States Patent
Taugher et al.

(10) Patent No.: US 7,333,126 B2
(45) Date of Patent: Feb. 19, 2008

(54) OPTICAL DISC HAVING LAYERS CORRESPONDING TO DIFFERENT COLORS AND SENSITIVE TO OPTICAL BEAM WAVELENGTHS

(76) Inventors: Lawrence N. Taugher, 3404 E. Harmony Rd., Fort Collins, CO (US) 80528; D. Mitchel Hanks, 3404 E. Harmony Rd., Fort Collins, CO (US) 80528; Kevin L Colburn, 3404 E. Harmony Rd., Fort Collins, CO (US) 80528; Greg J. Lipinski, 3404 E. Harmony Rd., Fort Collins, CO (US) 80528; Andrew L Van Brocklin, 1000 NE. Circle Blvd., Corvallis, OR (US) 97330; Jayprakash C. Bhatt, 1000 NE. Circle Blvd., Corvallis, OR (US) 97330; Jeffrey M. Valley, 1000 NE. Circle Blvd., Corvallis, OR (US) 97330

( * ) Notice: Subject to any disclaimer, the term of this patent is extended or adjusted under 35 U.S.C. 154(b) by 279 days.

(21) Appl. No.: 11/203,332

(22) Filed: Aug. 13, 2005

(65) Prior Publication Data

US 2006/0132588 A1 Jun. 22, 2006

Related U.S. Application Data

(63) Continuation-in-part of application No. 11/021,577, filed on Dec. 22, 2004.

(51) Int. Cl.
*B41J 2/435* (2006.01)

(52) U.S. Cl. ..... 347/224

(58) Field of Classification Search ..... 347/224–225; 369/44.23, 108; 544/58.4
See application file for complete search history.

(56) References Cited

U.S. PATENT DOCUMENTS 4,826,976 A * 5/1989 Borror et al. ..... 544/58.4
6,377,520 B2 * 4/2002 Freeman et al. ..... 369/44.23
2003/0179679 A1 * 9/2003 Morishima ..... 369/108

* cited by examiner

*Primary Examiner*—Hai Pham

(57) ABSTRACT

For at least some layers of a number of stacked layers of an optical disc that correspond to different colors, an optical beam is selectively impinged on a region of the optical disc. The optical beam has a wavelength to which the layer is uniquely sensitive as compared to other of the layers, to sufficiently heat the layer so as to cause the region to change from at least substantially translucent to a color to which the layer corresponds.

20 Claims, 5 Drawing Sheets

OPTICAL DISC HAVING LAYERS CORRESPONDING TO DIFFERENT COLORS AND SENSITIVE TO OPTICAL BEAM WAVELENGTHS

RELATED APPLICATIONS

The present patent application is a continuation-in-part of the previously filed and coassigned patent application entitled "A Thermally Sensitive Medium and Methods and Systems for Forming an Image on a Thermally Sensitive Medium," filed on Dec. 22, 2004, and assigned Ser. No. 11/021,577.

BACKGROUND

Optical disc drives have historically been used to optically read data from and optically write data to data regions of optical discs. More recently, optical disc drives have been used to optically write images to label regions of optical discs. For example, in the patent application entitled "Integrated CD/DVD Recording and Label", filed on Oct. 11, 2001, and assigned Ser. No. 09/976,877, a type of optical disc is disclosed in which a laser or other optical beam can be used to write to the label side of an optical disc. However, the approach provided in this patent application does not necessarily lend itself to full color labeling of an optical disc.

BRIEF DESCRIPTION OF THE DRAWINGS

The drawings referenced herein form a part of the specification. Features shown in the drawing are meant as illustrative of only some embodiments of the invention, and not of all embodiments of the invention, unless otherwise explicitly indicated.

DETAILED DESCRIPTION OF THE DRAWINGS

In the following detailed description of exemplary embodiments of the invention, reference is made to the accompanying drawings that form a part hereof, and in which is shown by way of illustration specific exemplary embodiments in which the invention may be practiced. These embodiments are described in sufficient detail to enable those skilled in the art to practice the invention. Other embodiments may be utilized, and logical, mechanical, and other changes may be made without departing from the spirit or scope of the present invention. The following detailed description is, therefore, not to be taken in a limiting sense, and the scope of the present invention is defined only by the appended claims.

Figure 1:
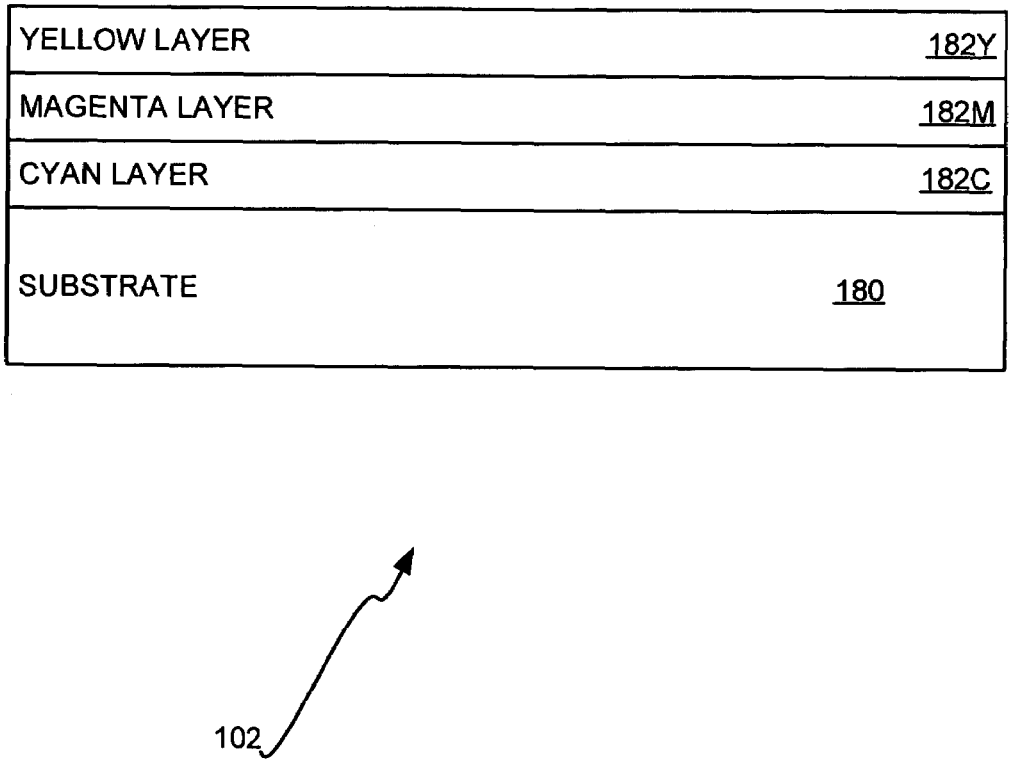
FIG. 1 is a diagram of the side profile of an optical disc having cyan, magenta, and yellow layers, according to an embodiment of the invention.

FIG. 1 shows an optical disc 102, according to an embodiment of the invention. The optical disc 102 has a substrate 180 on which there are a cyan layer 182C, a magenta layer 182M, and a yellow layer 182Y, collectively referred to as the stacked layers 182, because the layers 182 are stacked over one another in relation to the substrate 102. The substrate 180 may be a polycarbonate or other type of substrate, and may be at least substantially translucent. The optical disc 102 may have other layers, in addition to and/or in lieu of those depicted in FIG. 1, such as a data-recordable layer, a protective layer over and/or in-between the stacked layers 182, a heat-reflective antenna layer, and a white background layer between the stacked layers 182 and the substrate 180, among other types of layers.

It is noted that the ordering of the layers 182 as depicted in FIG. 1 is for example and illustrative purposes, and is not intended to limit embodiments of the invention. That is, the layers 182C, 182M, and 182Y may be ordered differently than as depicted in FIG. 1. Furthermore, there may be a different number and different colors of the layers 182 than as depicted in FIG. 1. That is, whereas three layers 182 are shown in FIG. 1, where these layers include a cyan layer 182C, a magenta layer 182M, and a yellow layer 182Y, in other embodiments there may be less than or more than three layers, having different colors in addition to and/or in lieu of cyan, magenta, and/or yellow layers.

Where the optical disc 102 includes a data-recordable layer, the data-recordable layer may be that of a compact disc (CD), a CD-readable (CD-R), which can be optically written to once, a CD-readable/writable (CD-RW), which can be optically written to multiple times, and so on. The data-recordable layer may further be the data-recordable layer of a digital versatile disc (DVD), a DVD-readable (DVD-R), or a DVD that is readable and writable, such as a DVD-RW, a DVD-RAM, or a DVD+RW. The data-recordable layer may also be the data-recordable layer of a high-capacity optical disc, such as a Blu-ray optical disc, and so on.

The stacked layers 182 correspond to different colors, such that the layer 182C corresponds to the color cyan, the layer 182M corresponds to the color magenta, and the layer 182Y corresponds to the color yellow. Initially, the layers 182 are at least substantially translucent. However, subjecting a region, area, position, or pixel of a given layer to a sufficient amount of heat causes that layer at that position to change in color from substantially translucent to the color to which the layer corresponds. For example, subjecting different regions of the cyan layer 182C to sufficient heat causes the cyan layer 182C to change from substantially translucent to cyan in color at those regions.

In this way, a full-color image is capable of being written to the optical disc 102. Such an image may be divided into cyan, magenta, and yellow components, and the layers 182 differently and selectively subjected to sufficient heat to cause the layers 182 to change color in accordance with the different color components of the image. While a cyan layer 182C, a magenta layer 182M, and a yellow layer 182Y are depicted in the embodiment of FIG. 1, in other embodiments the optical disc 102 may have other layers, corresponding to other different colors, in addition to and/or in lieu of the layers 182 shown in FIG. 1. For example, a black layer may further be included, which is substantially translucent but when subjected to sufficient heat changes to black in color.

The layers 182 are thus thermo-sensitive, or thermally sensitive, layers since they change, specifically in color, when subjected to sufficient heat. The layers 182 may in one embodiment be implemented as media that is commercially known as Thermo-Autochrome media, available from Fuji Photo Film Co., Ltd., of Tokyo, Japan. Other types of thermally sensitive layers may also be employed to implement the stacked layers 182 of the optical disc 102.

The threshold amount of heat needed to heat the layers 182 can be different for each of the layers 182. For example, the yellow layer 182Y may change in color to yellow at a first threshold temperature $T_Y$. The magenta layer 182M may change in color to magenta at a second threshold temperature $T_M$ that is greater than the first threshold temperature $T_Y$. The cyan layer 182C may change in color to cyan at a third threshold temperature $T_C$ that is greater than the second threshold temperature $T_M$. It is noted that as described in this paragraph, one embodiment of the invention has lower of the layers 182 having greater threshold temperatures, such that the lowest layer 182C, for instance, has the greatest threshold temperature $T_C$. However, in other embodiments of the invention, different of the layers 182 may have different threshold temperatures, such that, for instance, the lowest layer may not have the greatest threshold temperature.

The layers 182 are sensitive to different wavelengths of light to heat the layers 182 to cause them to change color. For example, the cyan layer 182C is in one embodiment sensitive to light having a wavelength of 830 nanometers (nm) to change regions of the layer 182C from at least substantially translucent to cyan in color. The magenta layer 182M is in one embodiment sensitive to light having a wavelength of 980 nm to change regions of the layer 182M from at least substantially translucent to magenta in color. The yellow layer 182Y is in one embodiment sensitive to light having a wavelength of 780 nm to change regions of the layer 182Y from at least substantially translucent to yellow in color.

Furthermore, in some embodiments at least some of the layers 182 are sensitive to different wavelengths of ultraviolet light to fix the layers 182 to prevent them from changing color when subsequently subjected to heat greater than their correspond threshold temperatures. That is, once a given layer is subjected to its corresponding wavelength of ultraviolet light, subsequent heating of the layer does not cause it to change color. As a result, the layer is fixed, or finalized. The magenta layer 182M is in one embodiment sensitive to ultraviolet light having a wavelength of 365 nm to fix the layer 182M, and the yellow layer 182Y is in one embodiment sensitive to ultraviolet light having a wavelength of 410 nm or 420 nm to fix the layer 182Y.

Figure 2:
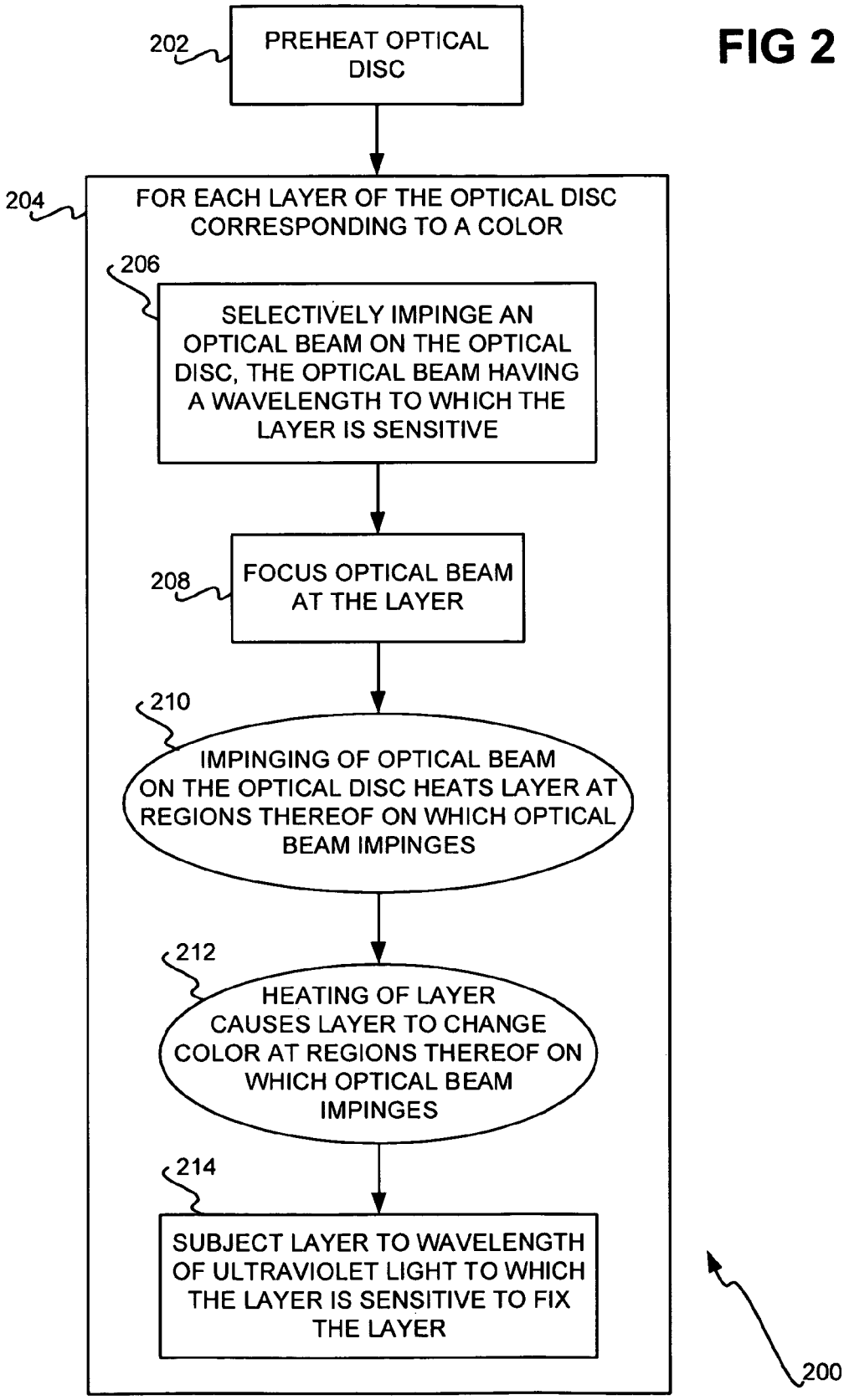
FIG. 2 is a flowchart of a method for optically writing a full-color image to the optical disc of FIG. 1, according to an embodiment of the invention.

FIG. 2 shows a method 200 for optically writing a full-color image to the stacked layer 182 of the optical disc 102, according to an embodiment of the invention. As with other methods of embodiments of the invention, the method 200 may be implemented at least in part as one or more computer program parts of a computer program stored on a computer-readable medium. The medium may be a magnetic storage medium, such as a hard disk drive, an optical storage medium, such as an optical disc, and/or a semiconductor storage medium, such as a memory, among other types of computer-readable media.

In some embodiments, the optical disc 102 may be preheated to shorten the length of time needed to heat regions of the layers 182 of the optical disc 102 to the threshold temperatures at which the layers 182 change color (202). Preheating may be accomplished as to the optical disc 102 as a whole, or the optical disc 102 may be preheated on a region-by-region basis prior to each region being potentially subjected to heat to cause the region of one of the layers 182 to change in color. Furthermore, the regions of the layers 182 may be selectively preheated, such that preheating occurs only where a given region of a given layer is to change in color. Preheating may be accomplished as is described in the previously filed and copending patent application entitled "Preheating Optical Disc Prior to Optically Writing to Label Area of Optical Disc," filed on Jun. 29, 2005, and assigned Ser. No. 11/170,686.

For each of the layers 182 of the optical disc 102, at least some of the parts 206, 208, 210, 212, and 214 may be performed (204). An optical beam is selectively impinged on the optical disc 102 (206). The optical beam has a wavelength corresponding to the wavelength to which the layer for which the part 206 is currently being performed is sensitive. The optical beam is selectively impinged based on the regions of the layer in question that are to change in color, in accordance with the corresponding color component of the image to be optically written to the optical disc 102. The optical beam is, in other words, impinged on the optical disc 102 only at these regions. For example, with respect to the yellow layer 182Y, the optical beam is selectively impinged based on the regions of the yellow layer 182Y that are to change in color to yellow, in accordance with the yellow component of the image. That is, the optical beam is selectively impinged on only these regions of the layer 182Y.

It is noted that in one embodiment, the part 206 of the method 200 may be performed simultaneously for two. or more of the layers 182. For instance, an optical beam having a wavelength corresponding to the yellow layer 182Y may impinge at the same time as an optical beam having a wavelength corresponding to the magenta layer 182M impinges, and/or at the same time as an optical beam having a wavelength corresponding to the cyan layer 182C impinges. Furthermore, it is noted that the order in which the part 204 is performed as to the layers 182 is not limited by embodiments of the invention, where the layers 182 are processed on a layer-by-layer basis, and not simultaneously. For instance, the top layer 182Y may be processed first in one embodiment, whereas the bottom layer 182C may be processed first in another embodiment, and so on. In some embodiments, once a region of an upper layer is marked by the optical beam such that the region changes from translucent to the associated color, a longer or more intense application of the optical beam may be required to mark the corresponding region on a lower layer, since the optical beam must pass through the non-translucent region on the upper layer in order to mark the lower layer. As part of the selective impinging of the optical beam on the optical disc 102, the optical beam may be particularly focused at the layer for which the part 206 is currently being performed (208). That is, rather than simply impinging the optical beam on the optical disc 102, the optical beam may further be specifically focused at the layer for which the part 206 is currently being performed. Such focusing can decrease the time needed to heat regions of this layer to cause them to change in color, and may further reduce thermal energy from undesirably affecting the other layers.

The selective emission or impinging of the optical beam on the optical disc 102 with a wavelength corresponding to the layer for which the part 204 is currently being performed thus heats this layer at regions on which the optical beam is impinged (210). The regions of this layer on which the optical beam is not impinged are therefore not heated. Heating the layer at the regions on which the optical beam is impinged causes the layer to change in color at these regions (212). The selective impinging of an optical beam in 206, causing selective heating of the layer in 210, and resulting in selective color change of the layer in 212, can be referred to as optically writing to the layer.

Finally, the layer for which the part 204 is currently being performed can in some embodiments be subjected to the wavelength of ultraviolet light to which the layer is sensitive, in order to fix the layer (214). Fixing the layer ensures that subsequent heating of the layer to (or above) its corresponding threshold temperature does not cause the layer to change color. That is, fixing the layer renders the layer at least substantially thermally insensitive. Fixing the layers 182 of the optical disc 102 may be unnecessary, since the layers 182 are tuned or sensitive to different wavelengths of light for heating purposes. For instance, when the cyan layer 182C is subjected to its corresponding wavelength of light for heating, the magenta and the yellow layers 182M and 182Y are not substantially heated by this light itself, because they are not sensitive to the same wavelength of light.

However, residual thermal energy from heating e.g. the cyan layer 182C may undesirably bleed over to the magenta and the yellow layers 182M and 182Y due to their close proximity with the cyan layer 182C, resulting in undesirable heating of the magenta layer 182M and/or the yellow 182Y to their corresponding threshold temperatures. That is, subjecting the cyan layer 182C to the wavelength of light to which it is uniquely sensitive for heating purposes does not result in the magenta and the yellow layers 182M and 182Y being substantially heated due to exposure to this wavelength of light, since they are not sensitive to the same wavelength as the cyan layer 182C is. However, because the cyan layer 182C is increasing in temperature, thermal conduction may nevertheless cause the magenta and yellow layers 182M and 182Y to heat to their corresponding threshold temperatures.

Therefore, fixing the magenta and yellow layers 182M and 182Y after they have been optically written to in part 206 of the method 200 may be desirable to prevent this situation from occurring. However, where the cyan layer 182C is optically written to last, after the magenta and yellow layers 182M and 182Y have been optically written to, the cyan layer 182C may not have to be fixed even where the magenta and yellow layers 182M and 182Y are fixed. This is because no further layers may be optically written to after the cyan layer 182C is optically written to, and the threshold temperature of the cyan layer 182C may be such that normal handling of the optical disc 102 is unlikely to result in the cyan layer 182C reaching that temperature.

In one embodiment, the part 204 of the method 200 is performed in relation to the layers 182 of the optical disc 102 in the increasing order of their threshold temperatures at which the layers 182 change in color. For example, the threshold temperature $T_Y$ of the yellow layer 182Y may be less than the threshold temperature $T_M$ of the magenta layer 182M, which may be less than the threshold temperature $T_C$ of the magenta layer 182C. Therefore, the part 204 is first performed in relation to the yellow layer 182Y, so that heating the yellow layer 182Y to the threshold temperature $T_Y$ does not cause any residual heating of the neighboring magenta layer 182M to the threshold temperature $T_M$, because the temperature $T_M$ is greater than the temperature $T_Y$. Similarly, the part 204 is performed next in relation to the magenta layer 182M, so that heating the magenta layer 182M to the threshold temperature $T_M$ does not cause heating of the neighboring cyan layer 182C to the threshold temperature $T_C$, because the temperature $T_C$ is greater than the temperature $T_M$.

Furthermore, heating of the magenta layer 182M to the threshold temperature $T_M$ may not cause the neighboring yellow layer 182Y to undesirably further change in color, for at least one of two reasons. First, the yellow layer 182Y may have been fixed after having been optically written to, such that it does not matter if it subsequently is heated to its threshold temperature $T_Y$. Second, because the magenta layer 182M is optically written to with an optical beam having a wavelength to which just the layer 182M is sensitive, and not the layer 182Y, there may be insufficient bleeding of the thermal energy from the layer 182M to the layer 182Y to heat the layer 182Y to its threshold temperature $T_Y$. For instance, there may be a thermal barrier between adjacent of the layers 182.

Finally, the part 204 is performed in relation to the cyan layer 182C in this embodiment of the invention. Heating of the cyan layer 182C to the threshold temperature $T_C$ may not cause the neighboring yellow and magenta layers 182Y and 182M to undesirably further change in color, for reasons similar to that described in the previous paragraph. Furthermore, where the yellow and magenta layers 182Y and 182M have been fixed to prevent heating of the cyan layer 182C from undesirably causing color change in the layers 182Y and 182M, the cyan layer 182C may not be fixed, as has been described. That is, because the cyan layer 182C is the last layer optically written to, it will not be subjected to bleeding thermal energy from other, subsequently optically written to layers that would have higher threshold temperatures.

Figure 3:
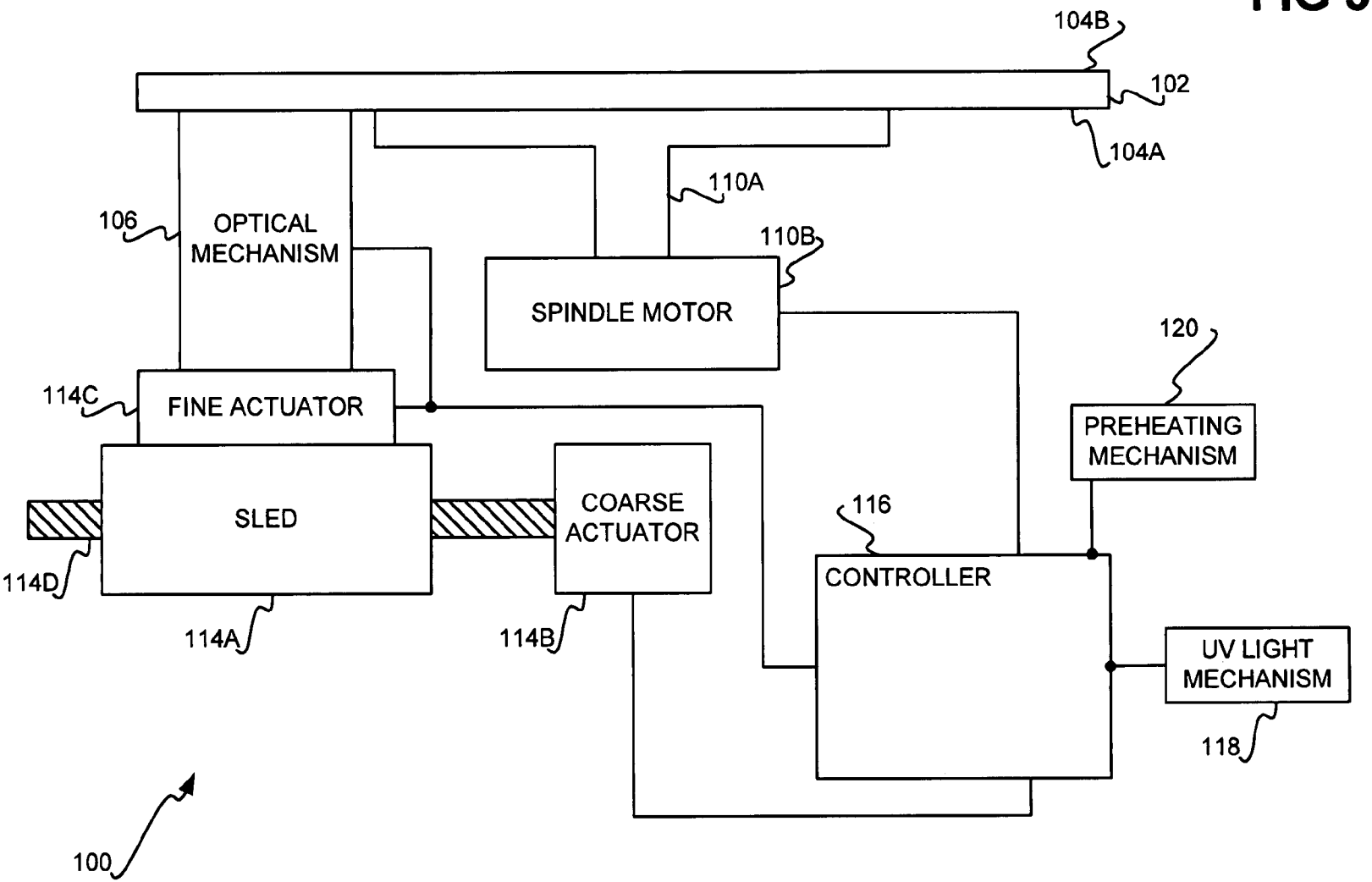
FIG. 3 is a diagram of an optical disc drive capable of optically writing a full-color image to the optical disc of FIG. 1, according to an embodiment of the invention.

FIG. 3 shows an optical disc drive 100, according to an embodiment of the invention. The optical drive 100 is at least for optically writing a full-color image to the stacked layers 182 of the optical disc 102, as has been described. As can be appreciated by those of ordinary skill within the art, the components depicted in the optical drive 100 are representative of one embodiment of the inventions and do not limit all embodiments of the invention. The optical drive 100 is depicted in FIG. 3 as including an optical mechanism 106. The optical mechanism 106 is capable of emitting optical beams of different wavelengths onto the optical disc 102 to heat the layers 182 of the optical disc 102 as has been described. The optical mechanism 106 may include a focusing mechanism, such as an objective lens, to focus the optical beams at particular of the layers 182, as has been described.

The optical drive 100 is also depicted in FIG. 3 as including a spindle 110A and a spindle motor 110B, which are collectively referred to as the first motor mechanism 110. The spindle motor 11OB rotates the spindle 110A, such that the optical disc 102 correspondingly rotates. The first motor mechanism 110 may include other components besides those depicted in FIG. 3. For instances the first motor mechanism 110 may include a rotary encoder or another type of encoder to provide for control of the spindle motor 110B and the spindle 110A.

The optical drive 100 is further depicted in FIG. 3 as including a sled 114A, a coarse actuator 114B, a fine actuator 114C, and a rail 114D, which are collectively referred to as the second motor mechanism 114. The second motor mechanism 114 moves the optical mechanism 106 to radial locations relative to a surface of the optical disc 102. The coarse actuator 114B is or includes a motor that causes the sled 114A, and hence the fine actuator 114C and the optical mechanism 106 situated on the sled 114A, to move radially relative to the optical disc 102 on the rail 114D. The coarse actuator 114B thus provides for coarse or large radial movements of the fine actuator 114C and the optical mechanism 106.

By comparison, the fine actuator 114C also is or includes a motor, and causes the optical mechanism 106 to move radially relative to the optical disc 102 on the sled 114A. The fine actuator 114C thus provides for fine or small movements of the optical mechanism 106. The second motor mechanism 114 may include other components besides those depicted in FIG. 3. For instance, the second motor mechanism 114 may include a linear encoder or another type of encoder to provide for control of the coarse actuator 114B and the sled 114A. Furthermore, either or both of the motor mechanisms 110 and 114 may be considered as the movement mechanism of the optical drive 100.

It is noted that the utilization of a fine actuator 114C and a coarse actuator 114B, as part of the second motor mechanism 114, is representative of one, but not all, embodiments of the invention. That is, to radially move the optical mechanism 106 in relation to the optical disc 102, the embodiment of FIG. 3 uses both a fine actuator 114C and a coarse actuator 114B. However, in other embodiments, other types of a second motor mechanism 114 can be used to radially move the optical mechanism 106 in relation to the optical disc 102, which do not require both a fine actuator 114C and a coarse actuator 114B. For instance, a single actuator or other type of motor may alternatively be used to radially move and position the optical mechanism 106 in relation to the optical disc 102.

The optical drive 100 is further depicted in FIG. 3 as including an ultraviolet light mechanism 118 and a preheating mechanism 120. The ultraviolet light mechanism 118 is capable of emitting ultraviolet light of different wavelengths to which the layers 182 of the optical disc 102 correspond, to fix at least some of the layers 182 after they have been optically written to by the optical mechanism 106, as has been described. The preheating mechanism 120 is to preheat the optical disc 102 to shorten the length of time needed for the optical mechanism 106 to sufficiently heat the layers 182, as has also been described.

The optical drive 100 is additionally depicted in FIG. 3 as including a controller 116. The controller 116 may be implemented in software, hardware, or a combination of software and hardware. The controller 116 controls movement of the first motor mechanism 110 and the second motor mechanism 114 to move the optical mechanism 106 in relation to the optical disc 102, and to rotate the optical disc 102. The controller 116 is further to cause the optical mechanism 106 to selectively emit optical beams of different wavelengths that impinge onto the optical disc 102 to cause the layers 182 thereof to change from at least substantially translucent to the colors to which the layers 182 correspond, as has been described, to optically write a full-color image on the optical disc 102.

Figure 4:
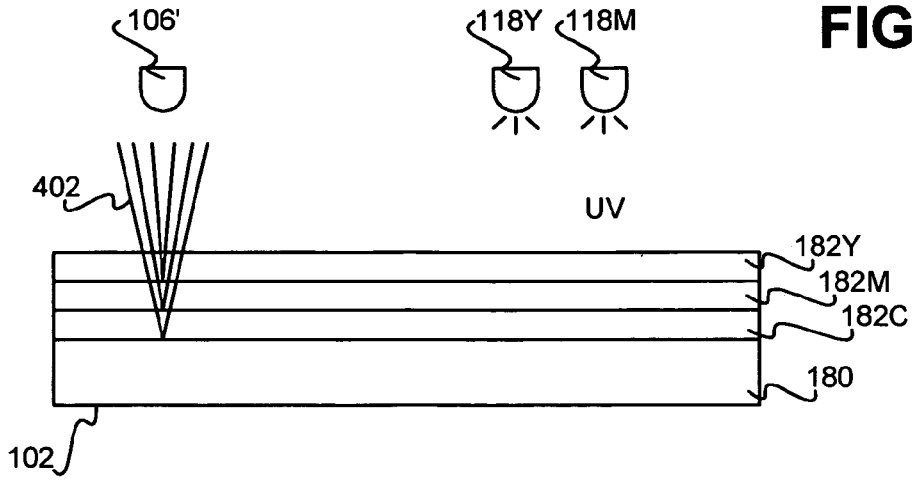
FIGS. 4 and 5 are diagrams depicting different configurations of an optical mechanism and an ultraviolet light mechanism of the optical drive of FIG. 3, according to an embodiment of the invention.
Figure 5:
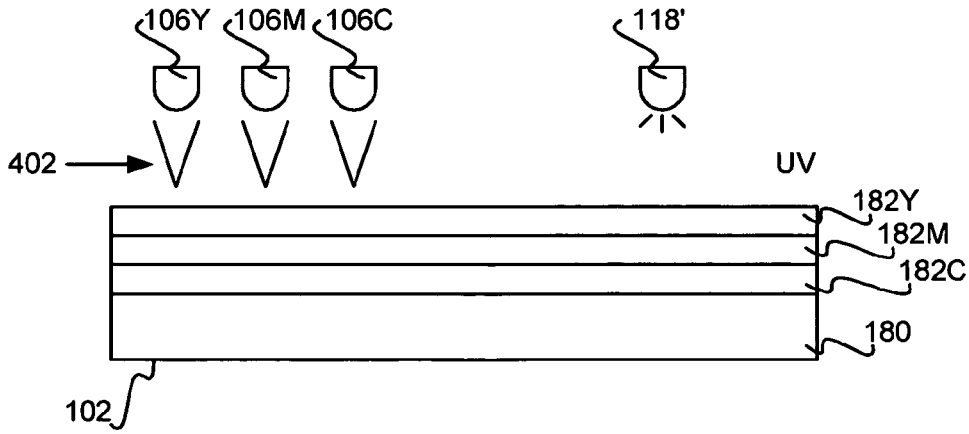

FIGS. 4 and 5 depict different configurations of the optical mechanism 106 and the ultraviolet light mechanism 118, according to varying embodiments of the invention. In FIG. 4, the optical mechanism 106 includes a single optical beam generator 106' that is capable of emitting optical beams 402 with the different wavelengths of light to which the layers 182 of the optical disc 102 are uniquely sensitive. That is, the same optical beam generator 106 is capable of emitting a first optical beam having a first wavelength to which the layer 182Y is uniquely sensitive as compared to the layers 182M and 182C, and a second optical beam having a second wavelength to which the layer 182M is uniquely sensitive as compared to the layers 182Y and 182C. The optical beam generator 106 is also capable of emitting a third optical beam having a third wavelength. to which the layer 182C is uniquely sensitive as compared to the layers 182Y and 182M.

As depicted in FIG. 4, the optical beam generator 106' is also capable of focusing the different optical beams 402 at the different layers 182, which is a more specific embodiment of impinging the optical beams 402 on the optical disc 102. Furthermore, the ultraviolet light mechanism 118 in FIG. 4 includes two different ultraviolet light generators 118Y and 118M, corresponding to the layers 182Y and 182M. Thus, the ultraviolet light generator 118Y is capable of generating ultraviolet light having a first ultraviolet wavelength to which the layer 182Y is sensitive, and the ultraviolet light generator 118M is capable of generating ultraviolet light having a second ultraviolet wavelength to which the layer 182M is sensitive.

By comparison, in FIG. 5, the optical mechanism 106 includes three optical beam generators 106Y, 106M, and 106C that are capable of emitting the optical beam 402 with different wavelengths of light to which the layers 182 of the optical disc 102 are uniquely sensitive. Thus, the optical beam generator 106Y is capable of generating a first optical beam having a first wavelength to which the layer 182Y is uniquely sensitive as compared to the layers 182M and 182C, and the optical beam generator 106M is capable of generating a second optical beam having a second wavelength to which the layer 182M is uniquely sensitive as compared to the layers 182Y and 182C. The third optical beam generator 106C is capable of emitting a third optical beam having a third wavelength to which the layer 182C is uniquely sensitive as compared to the layers 182Y and 182M.

As depicted in FIG. 5, the optical beam generators 106Y, 106M, and 106C do not focus their optical beam 402 at the different layers 182, but rather simply emit the optical beams 402 on the optical disc 102. (It is noted that the optical beam 402 in general may or may not be focused at the different layers 182.) Furthermore, the ultraviolet light mechanism 118 in FIG. 5 includes a single ultraviolet light generator 118' that is capable of emitting ultraviolet light of the different wavelengths to which the different layers 182 are uniquely sensitive. Thus, the same ultraviolet light generator 118' is capable of generating ultraviolet light having. a first ultraviolet wavelength to which the layer 182Y is uniquely sensitive, and ultraviolet light having a second ultraviolet wavelength to which the layer 182M is uniquely sensitive.

The configurations of the optical mechanism 106 and the ultraviolet mechanism 118 depicted in FIGS. 4 and 5 are representative of some embodiments of the invention, and other embodiments of the invention may have different configurations of the optical and ultraviolet mechanisms 106 and 118. For instance, in another embodiment, there may be a single optical beam generator 106', such as a laser photodiode, used in conjunction with a single ultraviolet light generator 118. Alternatively, there may be three optical beam generators 106Y, 106M, and 106C used in conjunction with two ultraviolet light generators 118Y and 118M.

Figure 6:
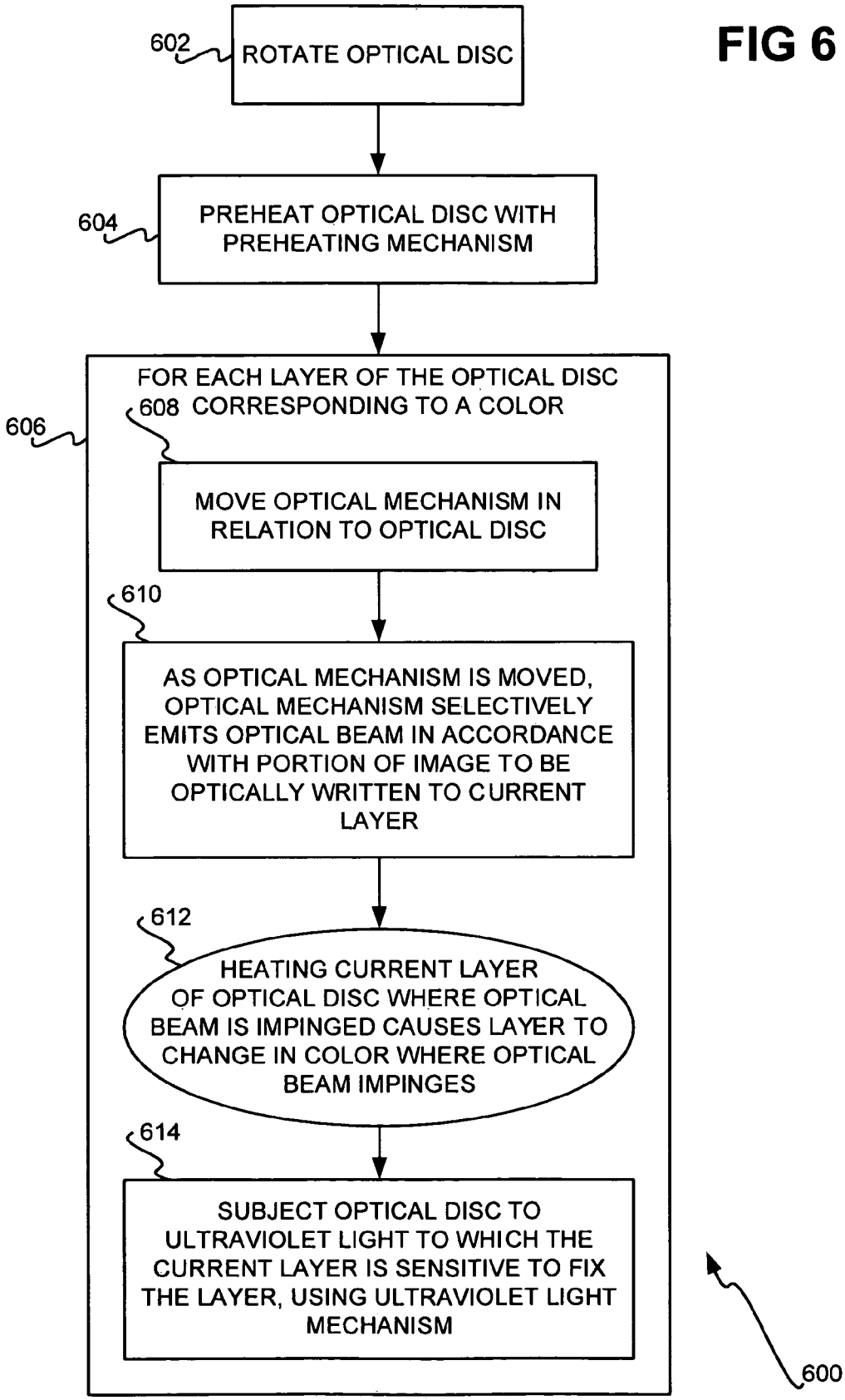
FIG. 6 is a flowchart of a method for optically writing a full-color image to the optical disc of FIG. 1, using the optical drive of FIG. 3, according to an embodiment of the invention.

FIG. 6 shows a method 600 for using the optical disc drive 100 to optically write a full-color image to the optical disc 102, according to an embodiment of the invention. That is, the method 600 is an adaptation of the method 200 of FIG. 2 for performance by the optical drive 100. The method 600 may further be performed by a computer program, or by the controller 116 of the optical drive 100, causing the various parts of the method 600 to be performed. For instance, the method 600 begins by rotating the optical disc 102 (602), such as via the first motor mechanism 110. The part 602 may further be performed by a computer program or the controller 116 causing the motor mechanism 110 to rotate the optical disc 102. In some embodiments, the optical disc 102 may further be preheated by the preheating mechanism 120 (604).

For at least some of the stacked layers 182 of the optical disc 102, the parts 608, 610, 612, and 614 are performed (606). The layer of the optical disc 102 in relation to which the part 606 is currently being performed is referred to as the current layer. First, the optical mechanism 106 is radially moved in relation to the optical disc 102 (608), such as by the second motor mechanism 114. As the optical mechanism 106 is moved, the optical mechanism 106 selectively emits an optical beam to which the current layer is uniquely sensitive as compared to the other layers, in accordance with the portion of the image to be optically written to the current layer (610). It is noted that in one embodiment, the part 610 of the method 600 may be performed simultaneously for two or more of the layers 182. For instance, an optical beam having a wavelength corresponding to the yellow layer 182Y may impinged at the same time as an optical beam having a wavelength corresponding to the magenta layer 182M impinges, and/or at the same time as an optical beam having a wavelength corresponding to the cyan layer 182C impinges. Such selective impinging results in heating of the current layer where the optical beam impinges, which causes the layer to change in color where the optical beam impinges (612). The part 612 can be considered as corresponding to both the parts 210 and 212 of the method 200 of FIG. 2.

Finally, in some embodiments the optical disc 102 may be subjected to ultraviolet light by the ultraviolet light mechanism 118 (614). The ultraviolet light has a specific wavelength to which the current layer is sensitive as compared to the other layers of the optical disc 102. As a result, the current layer is fixed, or finalized, so that it is no longer thermally sensitive. After all layers 182 have been fixed, no further image formation is possible on the disc 102.

It is noted that, although specific embodiments have been illustrated and described herein, it will be appreciated by those of ordinary skill in the art that any arrangement calculated to achieve the same purpose may be substituted for the specific embodiments shown. This application is thus intended to cover any adaptations or variations of the disclosed embodiments of the present invention. Therefore, it is manifestly intended that this invention be limited only by the claims and equivalents thereof.

We claim:

1. A method comprising:

for each layer of at least some layers of a plurality of stacked layers of an optical disc that correspond to different colors, selectively impinging an optical beam on a region of the optical disc, the optical beam having a wavelength to which the layer is uniquely sensitive as compared to other of the layers to sufficiently heat the layer so as to cause the region to change from at least substantially translucent to a color to which the layer corresponds; and, after selectively impinging the optical beam on the optical disc, subjecting the optical disc to a wavelength of ultraviolet light to which the layer is uniquely sensitive as compared to other of the layers to fix the layer, wherein fixing the layer renders the layer subsequently at least substantially resistant to thermally caused color change.

2. The method of claim 1, wherein selectively impinging the optical beam on the pixels of each layer sufficiently heats the layer to cause the layer to change color, but insufficiently heats other of the layers that have not yet been fixed such that the other of the layers do not change color.

3. The method of claim 1, wherein the optical beam selectively impinges the optical disc simultaneously for at least two of the layers.

4. The method of claim 1, wherein selectively impinging the optical beam on the optical disc for each layer comprises focusing the optical beam at the layer.

5. The method of claim 1, wherein selectively impinging the optical beam on the optical disc comprises:

selectively impinging a first optical beam on the optical disc, the first optical beam having a first wavelength to which a yellow-corresponding layer is uniquely sensitive, the yellow-corresponding layer selectively changing from at least substantially translucent to yellow in color corresponding to where the first optical beam impinges;

selectively impinging a second optical beam on the optical disc, the second optical beam having a second wavelength to which a magenta-corresponding layer is uniquely sensitive and different than the first wavelength, the magenta-corresponding layer selectively changing from at least substantially translucent to magenta in color corresponding to where the second optical beam impinges; and, selectively impinging a third optical beam on the optical disc, the third optical beam having a third wavelength to which a cyan-corresponding layer is uniquely sensitive and different than the first and the second wavelengths, the cyan-corresponding layer selectively changing from at least substantially translucent to cyan in color corresponding to where the third optical beam impinges.

6. The method of claim 5, further comprising:

after selectively impinging the first optical beam on the optical disc, subjecting the yellow-corresponding layer to a first wavelength of ultraviolet light to which the yellow-corresponding layer is uniquely sensitive to fix the yellow-corresponding layer; and, after selectively impinging the second optical beam on the optical disc, subjecting the magenta-corresponding layer to a second wavelength of ultraviolet light to which the magenta-corresponding layer is uniquely sensitive and different than the first wavelength of ultraviolet light to fix the magenta-corresponding layer.

7. The method of claim 1, further comprising preheating the optical disc to shorten a length of time needed for the optical beam to sufficiently heat each layer.

8. A method comprising:

for each layer of a plurality of stacked layers of an optical disc that correspond to different colors, moving an optical mechanism in relation to the optical disc;

as the optical mechanism is moved in relation to the optical disc, the optical mechanism selectively emitting an optical beam on the optical disc in accordance with a portion of an image to be optically written to the optical disc that corresponds to the color of the layer, the optical beam having a wavelength to which the layer is uniquely sensitive;

heating the layer of the optical disc where the optical beam impinges, resulting from impinging of the optical beam having the wavelength to which the layer is uniquely sensitive, to cause the layer to change from at least substantially translucent to the color to which the layer corresponds where the optical beam; and, for each of at least one of the layers, subjecting the optical disc to a wavelength of ultraviolet light to which the layer is uniquely sensitive to fix the layer, wherein fixing the layer renders the layer subsequently at least substantially resistant to thermally caused color change.

9. An optical disc drive comprising:

an optical mechanism capable of emitting optical beams of different wavelengths onto an optical disc having a plurality of stacked layers each corresponding to a different color and uniquely sensitive to a particular wavelength;

a controller to cause the optical mechanism to selectively emit an optical beam of the corresponding particular wavelength for each layer of the optical disc to sufficiently heat the layer so as to cause a region of the layer impinged by the optical beam to change from at least substantially translucent to the color to which the layer corresponds; and, an ultraviolet light mechanism capable of emitting ultraviolet light of different wavelengths onto the optical disc, the controller to cause the ultraviolet light mechanism to emit ultraviolet light of a different wavelength for each of at least one of the layers of the optical disc to which the layer is uniquely sensitive to fix the layer to render the layer subsequently at least substantially resistant to thermally caused color change.

10. The optical disc drive of claim 9, wherein the optical mechanism is to focus the optical beam at the layer of the optical disc that is sensitive to the different wavelength of the optical beam that the optical mechanism is currently emitting.

11. The optical disc drive of claim 9, wherein the optical mechanism comprises a single optical beam generator that is capable of generating the optical beams of the different wavelengths.

12. The optical disc drive of claim 9, wherein the optical mechanism comprises a plurality of optical beam generators, each of which is capable of generating an optical beam of one of the different wavelengths.

13. The optical disc drive of claim 12, wherein the optical beam generators are each capable of generating an optical beam simultaneously with generation of an optical beam by other of the optical beam generators.

14. The optical disc drive of claim 9, wherein the optical disc comprises a yellow-corresponding layer, a magenta-corresponding layer, and a cyan-corresponding layer, and the optical mechanism is capable of emitting optical beams of three different wavelengths to which the yellow-corresponding, the magenta-corresponding, and the cyan-corresponding layers are correspondingly sensitive.

15. The optical disc drive of claim 14, wherein the ultraviolet light mechanism is capable of emitting ultraviolet light of two different wavelengths to which the yellow-corresponding and the magenta-corresponding layers are correspondingly sensitive to fix the layers.

16. The optical disc drive of claim 9, further comprising a preheating mechanism to preheat the optical disc to shorten a length of time needed for the optical beam to sufficiently heat each layer.

17. An optical disc drive comprising:

first means for emitting optical beams of different wavelengths onto an optical disc having a plurality of stacked layers corresponding to different colors;

second means for causing the first means to selectively emit an optical beam of a different wavelength for each layer of the optical disc to which the layer is uniquely sensitive to sufficiently heat the layer to cause the layer to change from at least substantially translucent to the color to which the layer corresponds where the optical beam impinges; and, third means for emitting ultraviolet light of different wavelengths onto the optical disc, the second means further for causing the third means to emit ultraviolet light of a different wavelength for each of at least one of the layers of the optical disc to which the layer is uniquely sensitive to fix the layer to render the layer subsequently at least substantially resistant to thermally caused color change.

18. A computer-readable medium having a computer program stored thereon comprising:

a first computer program part to cause an optical mechanism to move relative to a surface of an optical disc having a plurality of stacked layers corresponding to different colors, while the optical disc is rotating;

a second computer program part to cause the optical mechanism, for each layer of the optical disc, to selectively emit an optical beam onto the optical disc that has a wavelength to which the layer is uniquely sensitive so as to cause the layer to change from at least substantially translucent to the color to which the layer corresponds where the optical beam impinges the optical disc; and, a third computer program part to cause an ultraviolet light mechanism, for each of at least one of the layers of the optical disc, to emit ultraviolet light to which the layer is uniquely sensitive to fix the layer such that the layer is subsequently at least substantially resistant to thermally caused color change.

19. The computer-readable medium of claim 18, wherein the second computer program part is to cause the optical mechanism to selectively emit the optical beam for each layer of the optical disc in accordance with a portion of an image to be optically written to the optical disc that corresponds to the color of the layer.

20. The computer-readable medium of claim 18, further comprising a fourth computer program part to cause a preheating mechanism to preheat the optical disc to shorten a length of time needed for the optical beam to sufficiently heat each layer.

* * * * *

UNITED STATES PATENT AND TRADEMARK OFFICE

CERTIFICATE OF CORRECTION

PATENT NO. : 7,333,126 B2
APPLICATION NO. : 11/203332
DATED : February 19, 2008
INVENTOR(S) : Lawrence N. Taugher et al.

It is certified that error appears in the above-identified patent and that said Letters Patent is hereby corrected as shown below:

In column 6, line 51, delete “11OB” and insert -- 110B --, therefor.

In column 11, line 3, in Claim 8, after “beam” insert -- impinges --.

Signed and Sealed this

Twelfth Day of August, 2008

JON W. DUDAS
*Director of the United States Patent and Trademark Office*